United States Patent [19]

Schöttle

[11] Patent Number: 4,461,587

[45] Date of Patent: Jul. 24, 1984

[54] EMBOSSING MACHINE HAVING A MOVABLE CARRIAGE FOR CHARACTER AND LIKE SPACING

[75] Inventor: Helmut A. M. Schöttle, Berlin, Fed. Rep. of Germany

[73] Assignee: Pitney Bowes Inc., Stamford, Conn.

[21] Appl. No.: 22,012

[22] Filed: Mar. 19, 1979

[30] Foreign Application Priority Data

Mar. 21, 1978 [DE] Fed. Rep. of Germany ..... 2812380

[51] Int. Cl.[3] ..... B41J 1/06

[52] U.S. Cl. ..... 400/131; 400/44; 400/48; 400/568; 400/705.1; 400/328

[58] Field of Search ..... 400/23, 44, 45, 46, 400/47, 48, 127, 128, 129, 130, 131, 132, 133, 134, 134.1, 134.2, 134.3, 303, 305, 320, 322, 328, 340, 568, 569, 705.1

[56] References Cited

U.S. PATENT DOCUMENTS

| | | | |
|---|---|---|---|
| 270,056 | 1/1883 | Hagemann | 400/134 |
| 698,966 | 4/1902 | Kitsee | 400/127 |
| 1,421,074 | 6/1922 | Gaunt | 400/134.2 |
| 1,560,209 | 11/1925 | Chisholm | 400/132 |
| 2,438,271 | 3/1948 | Curtis | 400/134.2 |
| 2,886,160 | 5/1959 | Frey | 400/303 |
| 2,951,571 | 9/1960 | Colyer et al. | 400/134 |
| 2,999,577 | 9/1961 | Colyer et al. | 400/134.3 |
| 3,059,750 | 10/1962 | Schnellmann | 400/134.2 |
| 3,315,860 | 4/1967 | Adams et al. | 400/568 X |
| 3,605,976 | 9/1971 | Angle | 400/127 X |
| 3,986,091 | 10/1976 | Quiogue et al. | 400/320 X |
| 4,088,216 | 5/1978 | LaManna et al. | 400/130 |
| 4,091,910 | 5/1978 | Bolton et al. | 400/134.2 X |

FOREIGN PATENT DOCUMENTS

| | | | |
|---|---|---|---|
| 458064 | 12/1936 | United Kingdom | 400/134 |

*Primary Examiner*—Ernest T. Wright, Jr.

*Attorney, Agent, or Firm*—Peter Vrahotes; Albert W. Scribner; William D. Soltow, Jr.

[57] ABSTRACT

Conveying apparatus for embossing machines for producing printing plates for address printing machines or for identification means made out of sheet metal or plastic material. The embossing machine conveying apparatus is capable of moving the printing plates in two directions which are perpendicular to each other. One of these directions is the direction required for character embossing within a print or read line and the second direction, which is perpendicular to the first, is in the direction of line spacing.

6 Claims, 2 Drawing Figures

EMBOSSING MACHINE HAVING A MOVABLE CARRIAGE FOR CHARACTER AND LIKE SPACING

BACKGROUND OF THE INVENTION

Many kinds of transport devices for embossing machines are already known in the art. Some of the oldest ones are similar to paper feeding devices in typewriters. For example, a spring driving means is used for the movement in the direction of the line to be embossed which can be wound by hand or by a motor drive, and the uniform character spacing is attained by means of a toothed rack or a ratchet cooperating with a so-called "control release" which releases one tooth of the toothed rack or the ratchet at a time when a key is operated.

Also the line spacing is performed similarly to typewriters where the feeding device is moved back into the position at which the line starts and operated through a ratchet device. These previous devices, however, can be automated only with relatively great difficulty. Automatic devices, however, are required for embossing machines which are separately controlled, for instance, as by being connected to an electronic computer or to a reading apparatus.

There is particularly great technical difficulty in producing an identity device with two different kinds of characters, as is customary for such identification means. For example, for the address of the owner of the identity card, characters are used having a height of 2.5 mm and the character space, for instance, is 2.54 mm. For the customer number, stylized machine readable characters are used having a height of 4 mm and the character space is 3.63 mm (1/7"). For this, two separate character stepping devices are required. To achieve this with automation is more difficult.

SUMMARY OF THE INVENTION

The present invention is concerned with a conveying apparatus very suitable for automation by having all its functions entirely electrically controlled. The conveying apparatus for two directional movement, which movements are perpendicular to each other, includes two lead screw drives which are arranged perpendicular to each other. These give the plate holder the possibility of movement as required for the embossing operation, preferably within a horizontal plane.

The screw drives, themselves, do not define the steps of spacing so that there are many possibilities as to their control with respect to driving and braking. It is particularly advantageous to have associated with each screw drive a direct current, reversible motor as a driving device. Thus in an especially simple manner the drive for the movement in the direction of the line or for the return movement in this direction of the line, and, moreover, the drive for the line spacing or the movement back into the home position also are attained.

In order to stop the lead screw without delay when the embossing position is reached, a disk brake is provided, the brake disk of which is connected to the lead screw to be rotated with it. The brake lining is pressed against a brake disk by means of magnetic force, whereby an electrical control of the braking operation is possible. A particularly suitable way for achieving this is to have a control disk that rotates together with an associated lead screw and which delivers a brake signal when the next embossing position is reached. By replacing the control disk, or by the arrangement of several disks which can be selectively operated, it would be possible without any difficulties to change from one character stepping or spacing to another without any difficulty. Thus it is preferable that the drive itself defines the character spacing in combination with the control disk.

For an automatic operation, as a rule, it is necessary to exactly indicate the position of the conveying apparatus, i.e. the position of the character and of the character space. For this purpose, in addition to the control disks which define the character spacing, a control plate is provided with coded indications of the embossing position, for example, alternating transparent and opaque areas. This control plate is scanned by means of a multiple light element. One of these parts is stationarily mounted and the other part is arranged to be moved together with the plate holder. Thus the entire control is performed electrically, speedily and in a simple manner.

As to the mechanical construction of the conveying apparatus having two screw drives which are arranged perpendicular to each other, it is especially advantageous to arrange the plate holder on a plate carriage and movable in a first direction of movement by means of a first screw drive through a lead screw which is rotatably mounted in the plate carriage. The plate carrriage itself is arranged in the housing to be moved in a second direction of movement perpendicular to the first direction by means of a second screw drive through a lead screw which is rotatably mounted in the housing. Depending upon the mechanical conditions, a further lead screw or a lead bar may be arranged parallel to the respective lead screws.

BRIEF DESCRIPTION OF THE DRAWING

In the accompanying drawing the perferred embodiment of the invention is illustrated wherein.

DETAILED DESCRIPTION OF THE PREFERRED EMBODIMENT

Figure 1:
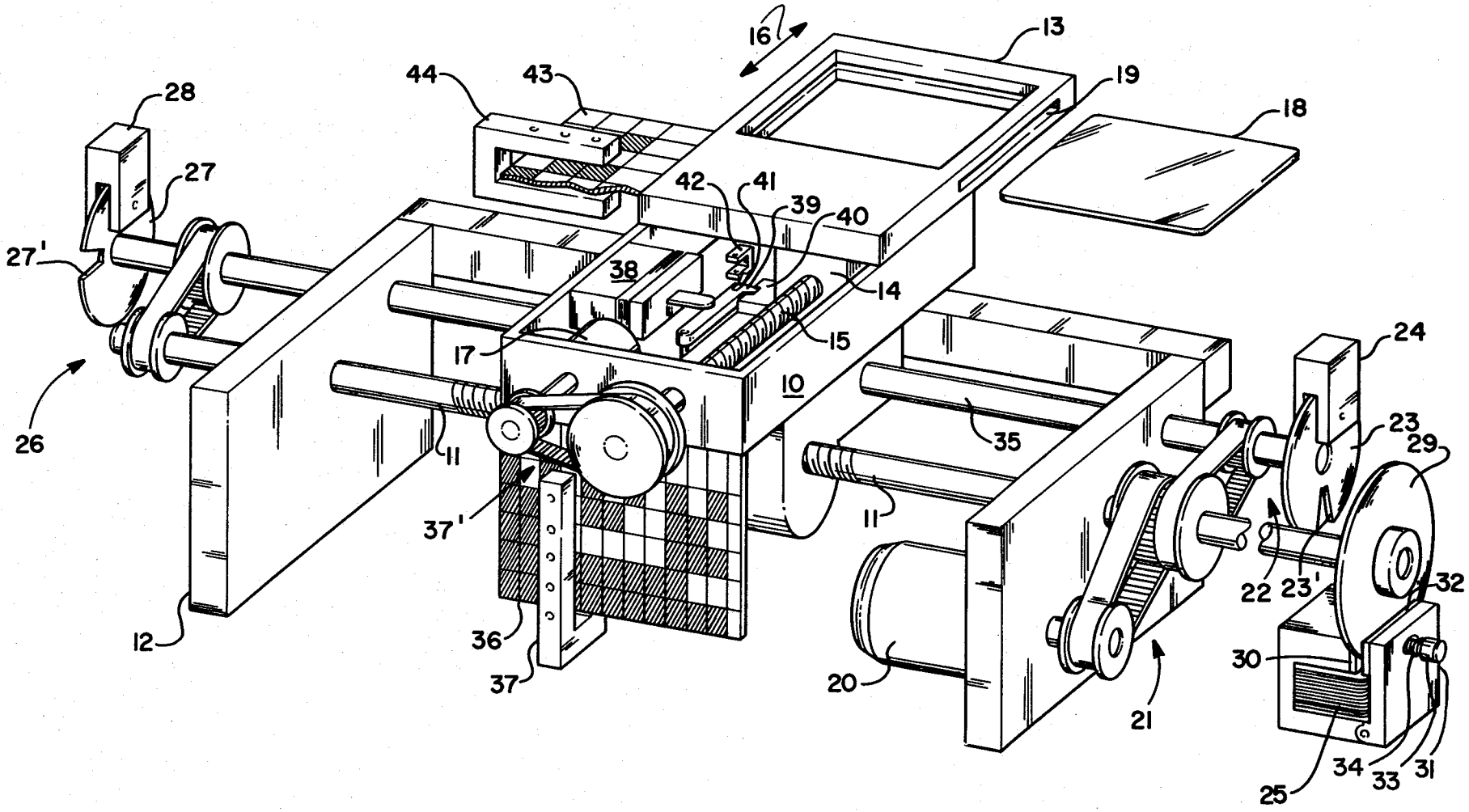
FIG. 1 is a longitudinal perspective view with cut-out portions of a conveying apparatus embodying the principles of the invention.

Referring to FIG. 1, a plate carriage 10 is shown which receives a first lead screw 11, which lead screw 11 is mounted on a portion of a housing 12. The lead screw 11 is mounted in a manner to be rotatable but not shiftable in the longitudinal direction. Therefore, its rotation causes the plate carriage 10 to move in a first path in the direction of the longitudinal axis of the screw 11 which is from left to right as seen in FIG. 1.

Located upon the plate carriage 10 is a plate holder 13 which is slidably mounted thereon. The plate holder 13 is provided with a projection 14 that extends toward the plate carriage 10 and receives a lead screw 15. The lead screw 15 is mounted by the plate carriage 10 in a manner to be rotatable but not shiftable in the transverse direction. A rotation of the lead screw 15, therefore, causes the plate holder 13 to move through its sliding path 16 in the direction as defined by the direction of rotation of a motor 17.

The plate holder 13 serves to receive and support a plate 18 which may be fed to it through an inlet slot 19. Thus the a plate 18 which is received within the plate holder 13 can be moved into each desired embossing position by means of the drive of lead screw 15 acting on the plate holder 13 itself or through the drive of the lead screw 11 acting on the plate carriage 10.

The drive for the lead screw 11 is supplied by a motor 20 which may be a direct current reversible motor as is also true for the motor 17. The lead screw 11 is driven by the motor 20 through a drive train shown generally at 21, that includes a nonslip toothed belt drive. Because the pitch of the lead screw 11 will normally not correspond to the desired character space, a control disk 23 is driven by the lead screw 11 through another drive train shown generally at 22 in a suitable gear ratio. For instance, in the case where the pitch of the lead screw 11 is 3 mm and the desired character space is 2.54 mm, the required gear ratio will be 1:0.8466. The control disk 23 is made out of opaque material. The control disk 23 is provided with an aperture 23' at its periphery and rotated through a sensor 24 such as a light sensor. As soon as the aperture 23' is received within the sensor 24, light passes through the control disk 23 and a braking signal is sent to a braking magnet or electric clutch 25 through a control device schematically illustrated in the FIG. 2 thereby incrementally rotating the lead screw 11 in series. In the case where a second character spacing is required, an additional control disk 27 is driven through an additional drive train shown generally at 26 in a suitable gear ratio and guided through a sensor unit 28. The ratio of the transmission gear 26 can be selected, for instance, so that a character space of 1/7 inch, or 3.628 mm will be attained. Also the sensor unit 28 delivers a braking impulse to a braking magnet 25 through the control, shown in FIG. 2, when the aperture 27' of the control disk 27 passes through the sensor 28 thereby rotating the lead screw 11 by a second series of increments. According to which of the control disks 23, 27 will be effective or which of the sensors 24, 28 will be connected to the braking magent 25 through the control circuit, a different character spacing can be attained.

The lead screw 11 which provides drive in the longitudinal direction, which is the direction of the line to be embossed, carries at its end a thin brake disk 29 which is yieldable in the direction of the axis and which acts as a quickly effective disk brake in cooperation with the braking magnet 25. The brake disk 29 is arranged so that it continuously slides against a first brake lining 30 under slight pressure. A movable armature 31 with a second brake lining 32 is also slightly pressed against the brake disk 29 by means of a pressure screw 33 that is over a spring 34 as is schematically indicated in FIG. 1. The thus attained slight permanent braking of the screw 11 is negligible. In this way it will be ensured that the braking force will increase 400 to 500 times so that the lead screw 11 will be stopped within a very short period when the braking impulse is delivered from one of the sensors 24, 28.

In order to ensure a uniform movement of the plate carriage 10 on the lead screw 11, the plate carriage 10 is slidably supported by a guide bar 35 which is mounted in the housing 12. This guide bar 35 may also be a lead screw which is driven in the same manner and at the same speed as the lead screw 11.

Additionally, a multi-sectional control plate 36 is connected to the plate carriage 10, formed as illustrated in the drawing, which is scanned, as shown, by a multiple light element 37. In this way, for instance, a control signal is associated with each character or embossing position. In the case where two different character spacings are desired, of course, two such control plates and two such multiple light elements will have to be provided. In the illustrated example the control plate 36 is carried by the plate carriage 10 and the multiple light element 37 is fixed to the housing 12. However, it is also possible to fix the control plate 36 to the housing 12 and to have it scanned by a multiple light element 37 which would be moved together with the plate carriage 10.

In the above manner the lead screw 15 and its drive motor 17, which drives the lead screw 15 through a drive train 37', are mounted in the plate carriage 10. In order to perform the line spacing a solenoid 38 is energized so that it will lift a pawl 39 to which it is connected out of a toothed rack 40 that is fixed to the plate holder 13, and thereby release the plate holder 13 to be moved along its sliding path 16 on the plate carriage 10.

A pawl 39 is provided with a tab 41 which interrupts a light beam in a light sensor 42 when it is lifted out of engagement with a toothed rack 40 to thereby enable the motor drive. The motor 17 rotates the screw 15 and therewith the plate holder 13 is moved together with the toothed rack 40 fixed to it in the direction of operation. When the solonoid 38 which causes the pawl 39 to be lifted over a tooth of the toothed rack 40 is de-energized then this pawl 39 abuts the next tooth of the toothed rack 40 and engages the next tooth space of the toothed rack 40 after the line spacing step has been completed. Simultaneously, the tab 41 leaves the light sensor 42 which, through the control which is schematically illustrated in the FIG. 2, disables the motor 17.

In order to move the plate holder 13 back into its home position, it is necessary to have the solenoid 38 energized through the entire period of the return operation, so that the pawl 39 will be lifted out of the toothed rack 40. The motor 17 is then reversed and the plate holder 13 is moved back into its home position through the drive from the lead screw 15.

For indicating when the proper line spacing is reached, a control plate 43 is provided that is connected to the plate holder 13. The control plate 43 is scanned by a multiple light element 44 that is fixed to the plate carriage 10. The setting of the line spacings, of course, could also be provided by a setting scheme as illustrated with respect to the lead screw 11, i.e. a setting by means of a disk brake controlled by a control disk rotating together with the screw 15. The embodiment comprising a pawl 39 and a toothed rack 40 as described above, however, has the advantage of a greater freedom relative to selectable line spaces.

Figure 2:
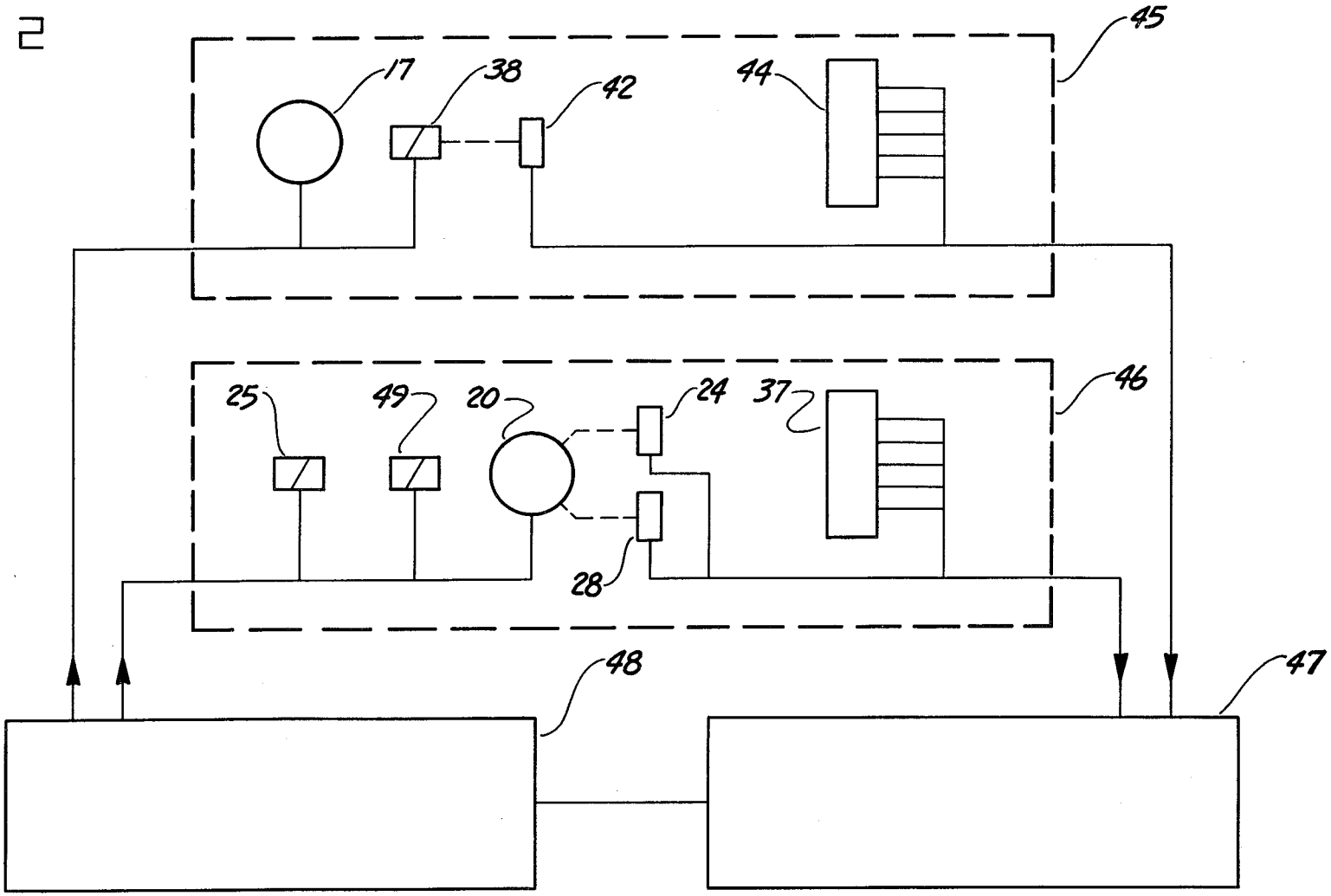
FIG. 2 is a diagram of the control device of the conveying apparatus shown in FIG. 1.

In FIG. 2 a control circuit is schematically shown wherein the block 45 corresponds to the transverse conveying portion that includes the plate holder 13 and the block 46 corresponds to the longitudinal conveying portion that includes the plate carriage 10. The signal circuits of both blocks are connected to a control circuit 47 which supplies power to the motors 17 and 20 or the magnetic devices 25, 38, and 49 through a power amplifier 48 as described previously. The magnetic device 49 may serve as a means for removing plates 18 in the plate holder 13. Details of the magnetic device 49 are fully explained in the applicant's co-pending application having Ser. No. 022,013 filed Mar. 19, 1979, now U.S. Pat. No. 4,255,073 issued Mar. 10, 1981.

What is claimed is:

1. Conveying apparatus for an embossing machine operative to emboss plates for address printing machines, identification means, and the like, comprising: a housing, a first lead screw rotatably mounted in said housing, a plate carriage mounted upon said first lead screw to be moved along a first path upon rotation of said first lead screw, a second lead screw rotatably mounted by said plate carriage, a plate holder mounted upon said second lead screw to be moved in a second path upon rotation of said second lead screw, first rotation means for rotating said first lead screw in a first series of increments, second rotation means for rotating said first lead screw in a second series of increments, third rotation means for rotating said second lead screw in a series of increments, braking means for braking said plate holder including a toothed rack connected to said plate holder and a pawl pivotally connected to said plate carriage and means for engaging and disengaging said pawl and said toothed rack, said pawl being provided with a control tab, and a light sensor supported by said plate carriage, said tab being receivable with said light sensor when said pawl is lifted out of said toothed rack.

2. Apparatus according to claim 1, wherein a lead bar is disposed within said housing parallel to said first lead screw and is received within said plate carriage thereby providing guide means to said plate carriage.

3. Apparatus according to claim 1, including a direct reversible current motor for providing drive to said first and second rotation means and means for providing operative connection between said motor and said first and second rotation means.

4. Apparatus according to claim 1, including means for braking said first lead screw including at least one brake disk mounted upon said first lead screw and at least one electric clutch supported by said housing, one of said electric clutches receiving a portion of one of said brake disks.

5. Apparatus according to claim 1, including means for braking said plate carriage comprising: at least one control disk that rotates with said first lead screw and at least one sensor supported by said housing, said sensor receiving at least a portion of said disk.

6. Apparatus according to claim 5, wherein said plate holder and said plate carriage each carry a control plate which is moved therewith and a pair of multiple light elements are supported by said housing and located to scan said control plates as said plate holder and plate carriage are moved in their respective paths.

* * * * *